United States Patent [19]

Brooks

[11] Patent Number: 4,839,063

[45] **Date of Patent: * Jun. 13, 1989**

[54] CLEANING OF A BODY OF LIQUID

[75] Inventor: David A. Brooks, Roodepoort, South Africa

[73] Assignee: Spooner Est, Vaduz, Liechtenstein

[ * ] Notice: The portion of the term of this patent subsequent to Mar. 24, 2004 has been disclaimed.

[21] Appl. No.: 927,872

[22] Filed: Nov. 7, 1986

Related U.S. Application Data

[63] Continuation-in-part of Ser. No. 710,069, Mar. 11, 1985, Pat. No. 4,652,366.

[30] Foreign Application Priority Data

Mar. 12, 1984 [ZA] South Africa ..... 84/1829

[51] Int. Cl.[4] ..... E04H 3/16

[52] U.S. Cl. ..... 210/780; 210/169; 210/242.1; 210/416.2; 15/1.7; 134/167 R; 134/21; 4/490

[58] Field of Search ..... 210/169, 416.2, 242.1, 210/238, 780; 4/490; 15/1.7; 134/167 R, 21

[56] References Cited

U.S. PATENT DOCUMENTS

| | | | |
|---|---|---|---|
| 2,975,791 | 3/1961 | Pansini | 134/167 R |
| 3,032,044 | 5/1962 | Pansini | 134/167 R |
| 3,108,298 | 4/1963 | Gelinas | 210/169 |
| 3,261,371 | 7/1966 | Vernon | 210/169 |
| 3,287,755 | 11/1966 | Pansini | 15/1.7 |
| 3,291,145 | 12/1966 | Arneson | 134/167 R |
| 3,295,540 | 1/1967 | Ortega | 15/1.7 |
| 3,392,738 | 7/1968 | Pansini | 15/1.7 |
| 3,758,276 | 4/1973 | Bond et al. | 210/169 |
| 3,796,373 | 3/1974 | Moore | 134/167 R |
| 3,860,518 | 1/1975 | Henricksen | 210/169 |
| 3,926,667 | 12/1915 | Gibellina | 134/167 R |
| 3,972,339 | 8/1976 | Henkin et al. | 210/169 |
| 4,040,864 | 8/1977 | Steeves | 210/169 |
| 4,087,286 | 5/1978 | Sexton | 134/167 R |
| 4,178,949 | 12/1979 | Mazon | 134/167 R |
| 4,281,995 | 8/1981 | Pansini | 134/167 R |
| 4,289,155 | 9/1981 | Sable | 134/167 R |
| 4,348,192 | 9/1982 | Pansini | 134/167 R |
| 4,356,582 | 11/1982 | Stephenson | 134/167 R |
| 4,429,429 | 2/1984 | Altschul | 15/1.7 |
| 4,431,538 | 2/1984 | Selsted | 210/169 |
| 4,503,874 | 3/1985 | Norton | 134/167 R |
| 4,652,366 | 3/1987 | Brooks | 210/169 |
| 4,768,532 | 9/1988 | Johnson | 134/167 R |

FOREIGN PATENT DOCUMENTS

| | | | |
|---|---|---|---|
| 2255784 | 5/1973 | Fed. Rep. of Germany | 210/169 |
| 2209137 | 8/1973 | Fed. Rep. of Germany | 134/167 R |
| 2360029 | 5/1975 | Fed. Rep. of Germany | 210/169 |

*Primary Examiner*—Peter Hruskoci
*Assistant Examiner*—Coreen Y. Lee

[57] ABSTRACT

An automatic swimming pool cleaning apparatus has a surface supply hose connected to a floating unit and a further underwater hose that is connected at one end to the surface unit in fluid communication with the outlet of the surface hose and at its other outlet end to a non-buoyant cleaning unit. The underwater hose and the cleaning unit have jets directed in a downstream direction so that the cleaning unit moves through water in the pool and the underwater hose pushes the surface unit around. The cleaning unit carries a bag in which debris is collected. The surface hose also carries a jet to pull the surface unit around. The surface unit also has a jet which displaces and rotates the surface unit.

22 Claims, 10 Drawing Sheets

CLEANING OF A BODY OF LIQUID

RELATED APPLICATION

This is a continuation-in-part of my co-pending U.S. patent application Ser. No. 710,069 filed Mar. 11, 1985 and now allowed U.S. Pat. No. 4,652,366.

BACKGROUND OF THE INVENTION

1. Field of the Invention

This invention relates to the cleaning of a body of liquid. In particular, it relates to a method of cleaning the body of liquid and to an apparatus for cleaning such a body of liquid. The body of liquid may, in particular, be a swimming pool.

2. Description of Prior Art

A large number of automatic pool cleaning systems have been devised and are in use. Some of such systems work under pressure, utilising pressurised water supplied by a pump and filter system of the pool or by a special pump.

One pool cleaning system is described in U.S. Pat. No. 3,261,371 issued to Vernon which has a number of flexible hoses each with a nozzle at its end, through which the pressurised water exits. A reaction thrust is exerted on each nozzle so that the flexible tubes move sinuously over the pool floor, with the ends of the tubes waving gently back and forth over arcs that vary. Any sediment in the pool is thus repeatedly loosened and held in suspension until it is removed by a filtration system of the swimming pool system. The system described in this patent has a main tube with a number of branch tubes that branch from the main tube. At the branch points, there are a pair of jets, there being one jet on one side of the main tube and the other on the other side thereof with both jets pointing in a downstream direction at an angle to the longitudinal axis of the main tube. Although this system will dislodge small particles of dirt, larger objects such as leaves, pieces of paper and other debris will quickly sink back to the floor of the swimming pool and will not remain in suspension and accordingly will not be removed by the filtration system.

U.S. Pat. No. 4,040,864 to Steeves discloses the use of a bag that is secured to the free end of a flexible tube that also has a nozzle to cause displacement of the tube. The Steeves system further has a floating body that has a rotatable wheel which engages the sides of the pool to propel the body around the pool, thereby dragging the tube and bag around in the pool. As the floating body is forced to follow the walls of the pool the bag will not follow a totally random path and, with most pools, the bag will not clean everywhere and dirt and debris will settle out, most particularly in corners.

A device for cleaning the side walls of a swimming pool at the water line region thereof is disclosed in U.S. Pat. No. 4,429,429 to Altschul. This device is buoyant and is attached to the end of a flexible tube. It has propulsion jets which point towards the hose, so that the device pulls the hose along. The device further has a bag which has a mouth pointing away from the hose with an auxiliary jet that is located at the mouth of the bag and is directed into the bag, towards the hose. The device is designed and intended to move along the side walls at the water line region, and it cannot remove dirt from the body of the water, or from the floor of the swimming pool, or from the side walls of the swimming pool below the water line.

A further system is disclosed in U.S. Pat. No. 4,281,995 to Pansini. This system has a first length of hose, the inlet of which is connected to a supply of water under pressure, and its outlet is connected to a float. A further length of hose has its inlet end carried by the float and in fluid communication with the outlet of the first hose, with the free end of the further hose also being supported by a float. Both the first and further hoses have jets which are directed upstream, so that the jets tend to maintain the hoses under tension.

SUMMARY OF THE INVENTION

It is a basic requirement for all automatic swimming pool cleaning systems that the entire pool be kept clean. As it is not possible to pre-programme a cleaner to traverse a predetermined path in which the entire pool will be cleaned, a primary objective is for motion of a cleaning unit or head to be as random as possible and also that the apparatus should not get stuck in a corner, against a step or any other projection.

The accomplishment of this object is achieved by an apparatus for cleaning a body of liquid, the apparatus having a supply hose, a buoyant surface unit, a drive hose and a nonbuoyant cleaning unit. The supply hose has its inlet end connected to a supply of liquid under pressure and its outlet is connected to the surface unit. The supply hose has at least one jet intermediate its ends which is angled towards the outlet end to provide a thrust that has a transverse component and a longitudinal component that is directed in an upstream direction so that the supply hose pulls the surface unit through the body of liquid. The surface unit also has a jet displacing means for displacing it through the liquid. An inlet end of the drive hose is also supported by the surface unit in fluid communication with the supply hose, with a remote outlet end of the drive hose being attached to the cleaning unit. The drive hose also has a number of jets intermediate its ends that are also angled towards the outlet end to provide a transverse thrust and an upstream longitudinal thrust that pushes the surface unit about and pulls the cleaning unit through the liquid. In regard to the cleaning unit it has a body portion that has an open mouth facing towards the drive hose to receive debris as the unit moves through the body of liquid, a support member defining the mouth and a woven bag carried in the unit by the support member for collecting debris. The cleaning unit also has a hollow portion connecting the body portion to the outlet end of the drive hose to receive pressurised liquid. A main jet is carried by the unit in fluid communication with the hollow portion and is positioned to discharge the liquid in a direction to develop thrust both longitudinally of the drive hose to assist the drive jets in driving the drive hose and the cleaning unit and transversely to displace the cleaning unit to one side. The cleaning unit also has an auxiliary jet in fluid communication with the hollow portion and suitably positioned to discharge liquid towards the mouth to assist in the passage of debris into the bag.

BRIEF DESCRIPTION OF THE DRAWINGS

The invention is now described, by way of examples, with reference to the accompanying drawings, in which.

DESCRIPTION OF TWO PREFERRED EMBODIMENTS

Figure 1:
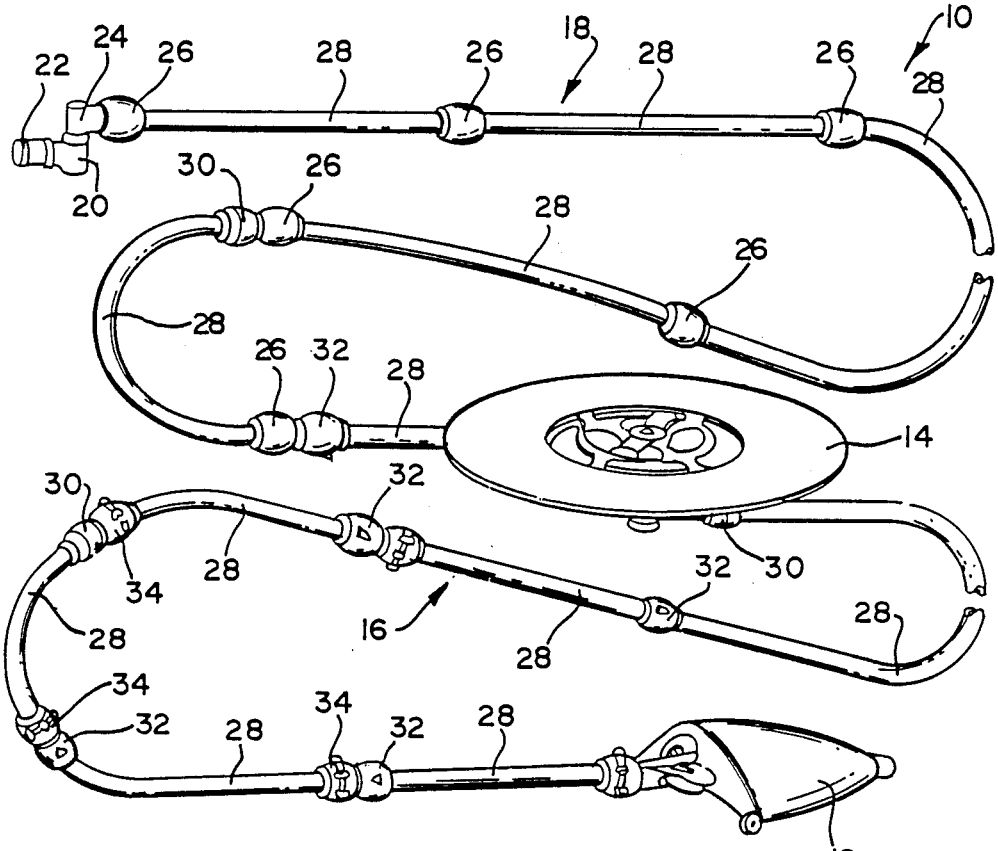
FIG. 1 shows a perspective view of a first embodiment of a swimming pool cleaning apparatus in accordance with the invention.

Referring to FIG. 1 of the drawings, an embodiment of a swimming pool cleaning apparatus is designated generally by reference numeral 10. As will be explained below, the apparatus 10 operates by means of a pressure principle.

The apparatus 10 has two prime components - a cleaning head 12 and a surface unit 14. The cleaning head 12 is shown in more detail in FIGS. 2 and 3 and the surface unit 14 is shown in more detail in FIGS. 4, 5 and 6. The cleaning head 12 is connected to the surface unit 14 by means of an underwater hose 16 and the surface unit 14 is connected to an inlet of the swimming pol that is to be cleaned (not shown) through which water returns to the pool, by means of a surface hose 18 and a swivel connector 20.

The connector 20 has a tubular inlet 22 which is engaged with the inlet of the swimming pool and an outlet 24 which is connected to the hose 18 by means of a connector 26. The inlet 22 and outlet 24 are swivably connected to one another. The hose 18 comprises sections 28 which are connected to one another by means of connectors 26, 30 and 32. The connectors 26 have buoyant elements which cause the hose 18 to float on the surface. The connectors 30 are swivel connectors and are shown more clearly in FIG. 9. The connectors 32 have jets and are shown more clearly in FIG. 7.

Similarly, the underwater hose 16 has sections 28 that are the same as those for the surface hose 18, the sections 28 being connected to one another by jet connectors 32, the swivel connectors 30 and wheeled connectors 34. The wheeled connectors 34 are shown in more detail in FIG. 8.

Figure 2:
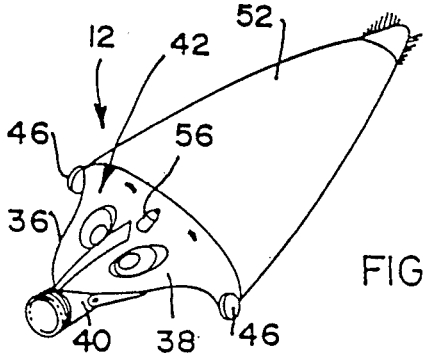
FIG. 2 shows a plan view of a cleaning head of the apparatus.
Figure 3:
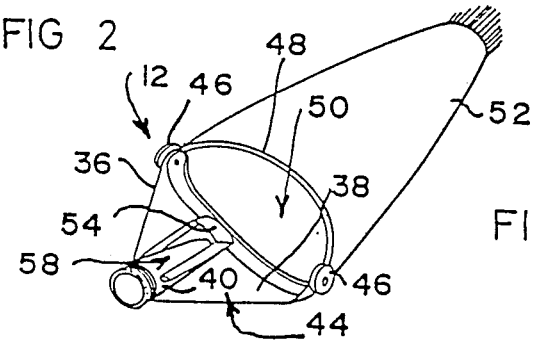
FIG. 3 shows an underneath plan view of the cleaning head.

Turning now to FIGS. 2 and 3, the cleaning head 12 is shown. The cleaning head 12 has a body portion 36 that comprises a curved section 38 and a hollow central section 40. The curved section 38 is curved to define a convex side 42 and a concave side 44. At the ends of the curved section 38 wheels 46 are provided. A curved support member 48 is also connected to the ends of the curved section 38 to define a mouth 50. The support member 48 also performs a scraping function. A woven bag 52 is secured to the support member 48 and the curved section 38 such that, as the body portion 36 is displaced through the water (in a manner which will be described below) water with debris suspended therein flows into the bag 52 through the mouth 40, with debris being collected in the bag 52. A scraper member 54 which is angled with respect to the body portion 36 and which is hingedly attached thereto, on the convex side 44 of the body portion 36, is also provided. The scraper 54 is angled such that it is displaced away from the body portion 36 as the body portion 36 is displaced through the water. The body portion 36 is displaced through the water by means of a main jet 56 which projects from the convex side 42 of the body portion 36 and is angled thereto, pointing in the general direction of the bag 52 and keeping the wheels 46 in contact with the walls or floor of the pool. The jet 56 communicates with the interior of the hollow section 40. A smaller auxiliary jet 58 is provided on the other side of the body portion 36 and is angled towards the mouth 50 to assist the passage of debris into the bag 52. It will be appreciated, that in use, water flowing out of the main jet 56 causes the cleaning head 12 to be displaced through the water and to have a component of thrust towards the wheels 46.

Figure 4:
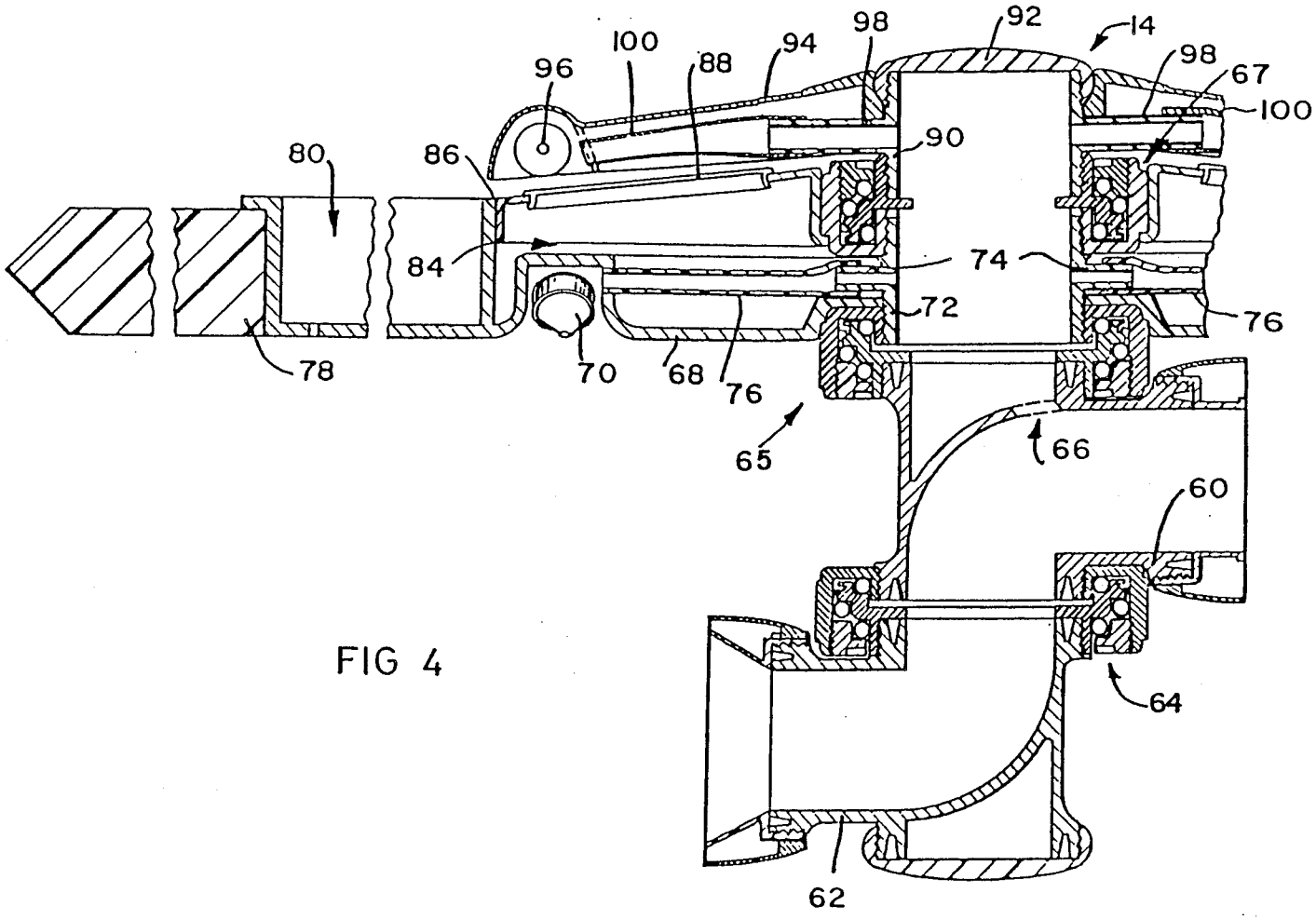
FIG. 4 shows a sectioned view of part of a surface unit of the apparatus.
Figure 5:
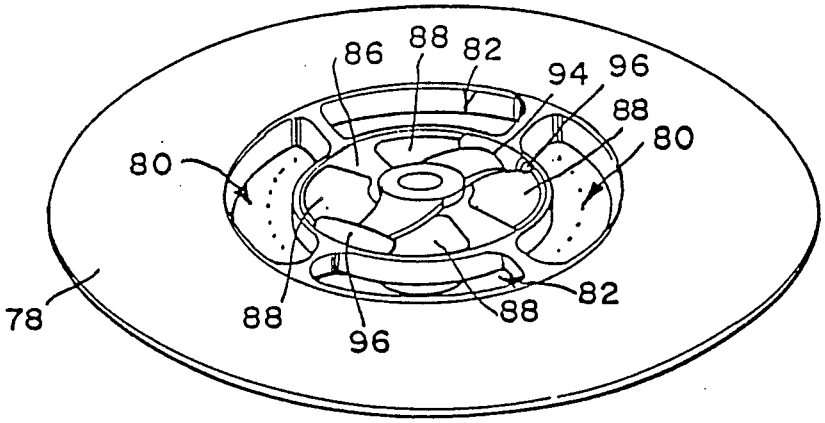
FIG. 5 shows an oblique plan view of the surface unit.
Figure 6:
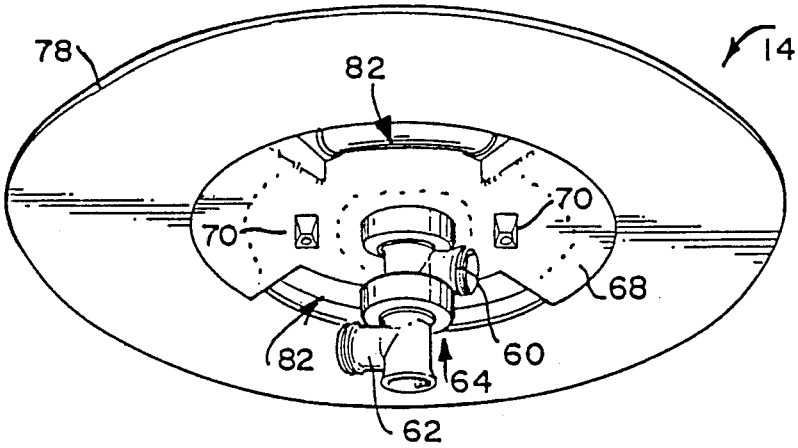
FIG. 6 shows an oblique underneath view of the surface unit.

Turning now to FIGS. 4, 5 and 6, the surface unit 14 is shown therein. The surface unit 14 has a tubular inlet member 60 that is cranked and a tubular outlet member 62 that is also cranked. The surface hose 18 is connected to the inlet member 60 and the underwater hose 16 is connected to the outlet member 62. The two members 60 and 62 are connected together by means of a bearing arrangement 64 so that they are rotatable with respect to a rotational axis which is vertically disposed in use. The inlet member 60 further has an aperture 66 through which water is supplied to further jets incorporated in the surface unit 14. Thus, the surface unit has a main tray 68 which is rotatably attached to the inlet member 60 by means of a further bearing arrangement 65 and carries two displacing jets 70 (only one of which is shown in FIG. 4) which project from the underneath surface of the tray 68 at an angle, as is shown in FIG. 6. The tray 68 is secured to a first tubular carrier 72 which in turn is connected to the inlet member 60 by means of the bearing arrangement 65, to be in communication with the aperture 66. This carrier 72 has two spigots 74 which are connected to the jets 70 by means of pipes 76. Although the jets 70 are equally spaced from a central axis of the tray 68, and are angled in the same direction, one of the jets is smaller than the other. Thus, in use, as water exits from the jets 70 the tray 68 will be displaced linearly through the water by a thrust vector component that passes through the rotational axis, and will also be rotated about the inlet member 60, which in turn will cause the abovementioned thrust vector component to change its alignment relative to the pool-shell.

Secured to the periphery of the central tray 68 is a ring 78 that is hollow or is of foamed plastic which causes the surface unit 14 to float in the water. Further, the central tray 68 has two outer compartments 80 for the dispersal of liquid or powdered chemicals, two openings 82 and an annular dished region 84 for the containment of chemical tablets. A cover 86 closes off this dished region 84. The cover 86 has four openings (for the insertion of tablets) which are closed by removable lids 88.

A second tubular carrier 90 is secured to the first carrier tube 72 by means of a further bearing arrangement 67 such that the carriers 90 and 72 are in communication with one another. The second carrier 90 is closed off by means of a cap 92. An off-balance spinner 94 is secured to the second carrier 90. The spinner 94 has two opposed jets 96 which are connected to spigots 98 of the second carrier 90 by means of pipes 100. In use, the spinner 94 is caused to rotate due to water exiting the jets 96. Because the spinner 94 is not balanced, this imparts a vibration to the surface unit 14 which inhibits sticking of the bearing arrangements 64, thus facilitating the constant and random re-alignment of the asymmetrical jets 70 of the surface unit 14 relative to the surface hose 18, and of the surface hose 18 relative to the underwater hose 16. Additionally, this vibration causes a pulsation down the length of both hoses 16 and 18, inhibiting their coming to rest against the pool-shell.

Figure 7:
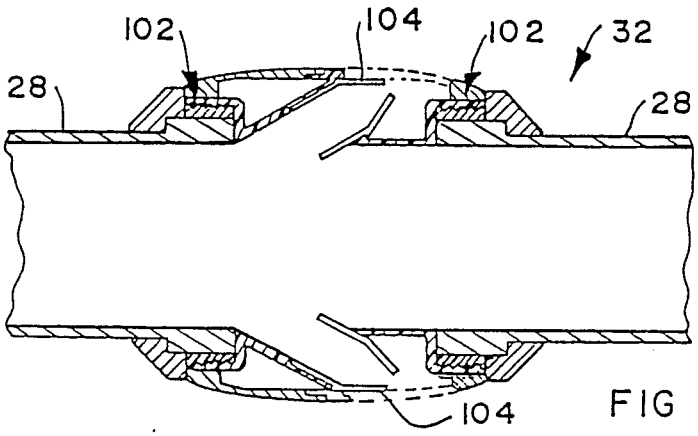
FIG. 7 shows a sectioned view of a jet connector which connects together two sections of hose of the apparatus.

Referring now to FIG. 7, a jet connector 32 is shown therein. The connector 32 has thread formations 102 at each end by means of which the hose sections 28 are secured thereto, and also incorporates cavities to hold weights for the attainment of optimum buoyancy of underwater hose 16. The connector 32 also has either one or two angled jets 104 which communicate with the interior thereof. It will be understood that in use water flows out of the jets 104 causing the connector 32 to be displaced in the water, thereby also moving the hose sections 28. Where two jets 104 are employed the resultant line of thrust is along the longitudinal axis of the hose 16, but where only one jet 104 is employed there is an additional component of thrust at right angles to this axis. The two or three jet connections 32 closest to the cleaning head 12 will have only one jet 104 each. The section of underwater hose 16 on which they occur will remain unswivelably fixed relative to the cleaning head 12, but swivelably fixed relative to the rest of the underwater hose 16. The line of thrust of each will be in the same plane as that of the main jet 56, and in view of the transverse component of thrust possessed by all these jets, the cleaning head 12 will be mostly held in contact with the walls and floor of the pool, and when it does break away will soon automatically correct its attitude and restore its wheel-to-wall/floor contact.

Figure 8:
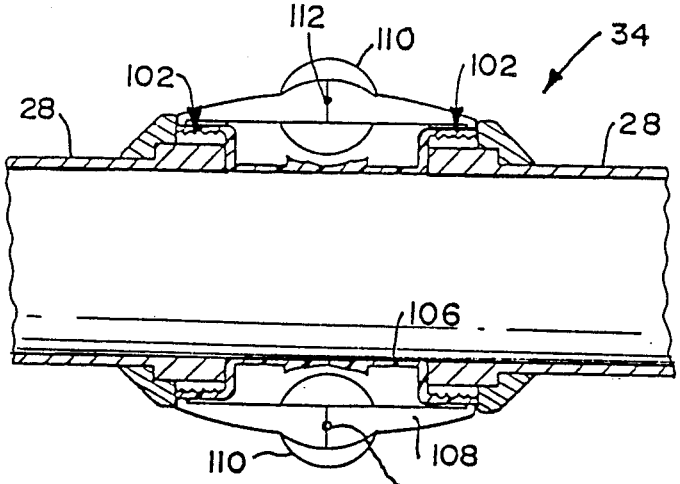
FIG. 8 shows a sectioned view of a wheeled connector.

Referring to FIG. 8, the wheeled connector 34 is shown therein. The connector 34 has a tubular body 106 which has threaded formations 102 for connection to the hose sections 28, as with the connector 32. A cage 108 is rotatably mounted on the body portion 106 to be rotatable about a longitudinal axis of the body portion 106. The cage 108 carries eight wheels 110 which are rotatable about axles 112 that are transverse to the longitudinal axis. Thus, as the hose sections 28 are displaced through the water, every now and again the hose sections 28 will tend to rub against wall or floor portions of the swimming pool. At these times, the wheels of the connectors 34 will engage the walls or floor thereby protecting the hose sections 28 and facilitating movement of the underwater hose through the water both in the direction of its longitudinal axis and at right angles to it.

Figure 9:
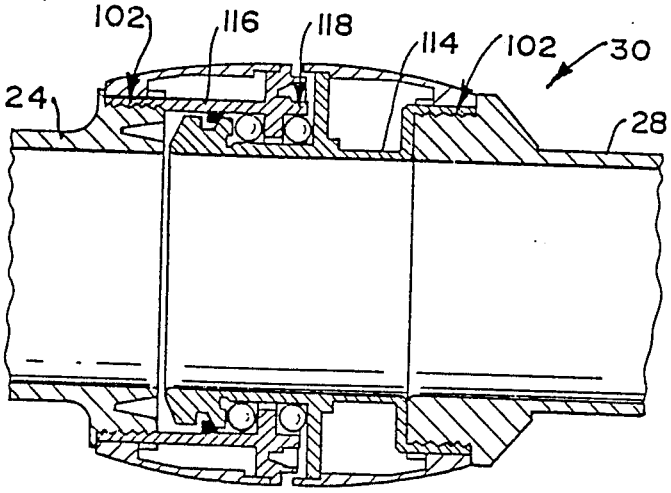
FIG. 9 shows a sectioned view of a swivel connector.

Referring to FIG. 9, a swivel connector 30 is shown. The swivel connector 30 has tubular portions 114 and 116 which each have threaded regions 102 and are swivably connected to one another by means of a bearing arrangement 118. By means of the bearing arrangement 118 the members 114 and 116 are able to rotate with respect to one another. Thus, adjacent hose sections 28 may rotate with respect to one another, thus randomly altering the resultant directions of thrust of those jet connectors 32 having only one angled jet 104.

Figure 10:
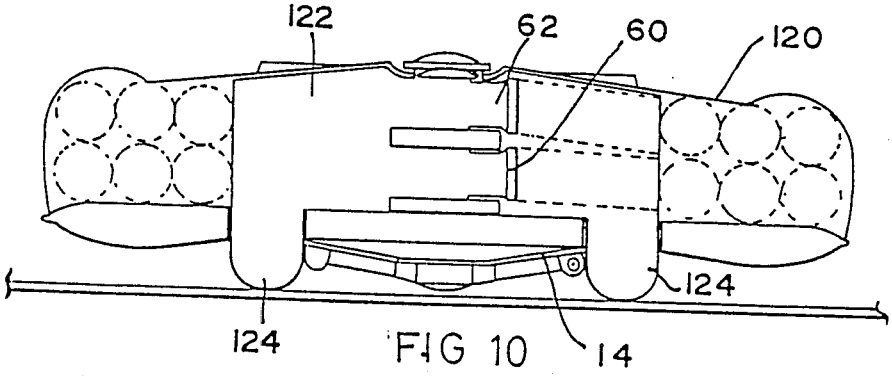
FIG. 10 shows schematically how the surface unit is utilised to store hoses of the apparatus.

Referring to FIG. 10, the surface unit 14 is shown in an inverted position with a reel unit 120 that is utilised to roll up the surface hose 18 and underwater hose 16 about a core 122 that has feet 124 which project through the apertures 82 in the central tray 68.

It will accordingly be understood that when the apparatus 10 is in use, the cleaning head 12 is caused to move through the water collecting dirt therein. Due to the action of the main jet 56 and the jets 104 of the connectors 32 the underwater hose 28 and the cleaning head 12 move randomly through the swimming pool. Further, due to the inter-dependent action of the jet connectors 32, the swivel connectors 30 and the wheel connectors 34 the possibility of the cleaning head 12 being caught in any part of the pool is extremely small. Further, due to the constant and random realignment of these components the possibility of the cleaning head 12 moving through a repeating pattern is also very small. Further, as the surface unit 14 itself moves randomly around the pool the randomness of movement of the cleaning head 12 is enhanced. It will also be appreciated that if the surface unit 14 comes into contact with a wall portion of the swimming pool, it will rotate as it moves along the wall, thus overpowering the lesser tendency to rotate caused by the asymmetrical jets 70 (in conjunction with the vibration caused by the spinner 94). The more sudden and vigorous realignment of the linear thrust vector of the jets 70 further enhances the randomness of the entire system. When this line of linear thrust is opposed to the direction of movement of the underwater hose 16, the latter slows down and "snakes" randomly in both the horizontal and vertical planes. When the linear thrust of these jets 70 is in the same direction as the movement of the underwater hose 16, the latter speeds up and proceeds from one area of the pool to another by a more direct route, tending to follow the equally rapid passage of the surface unit 14.

Figure 11:
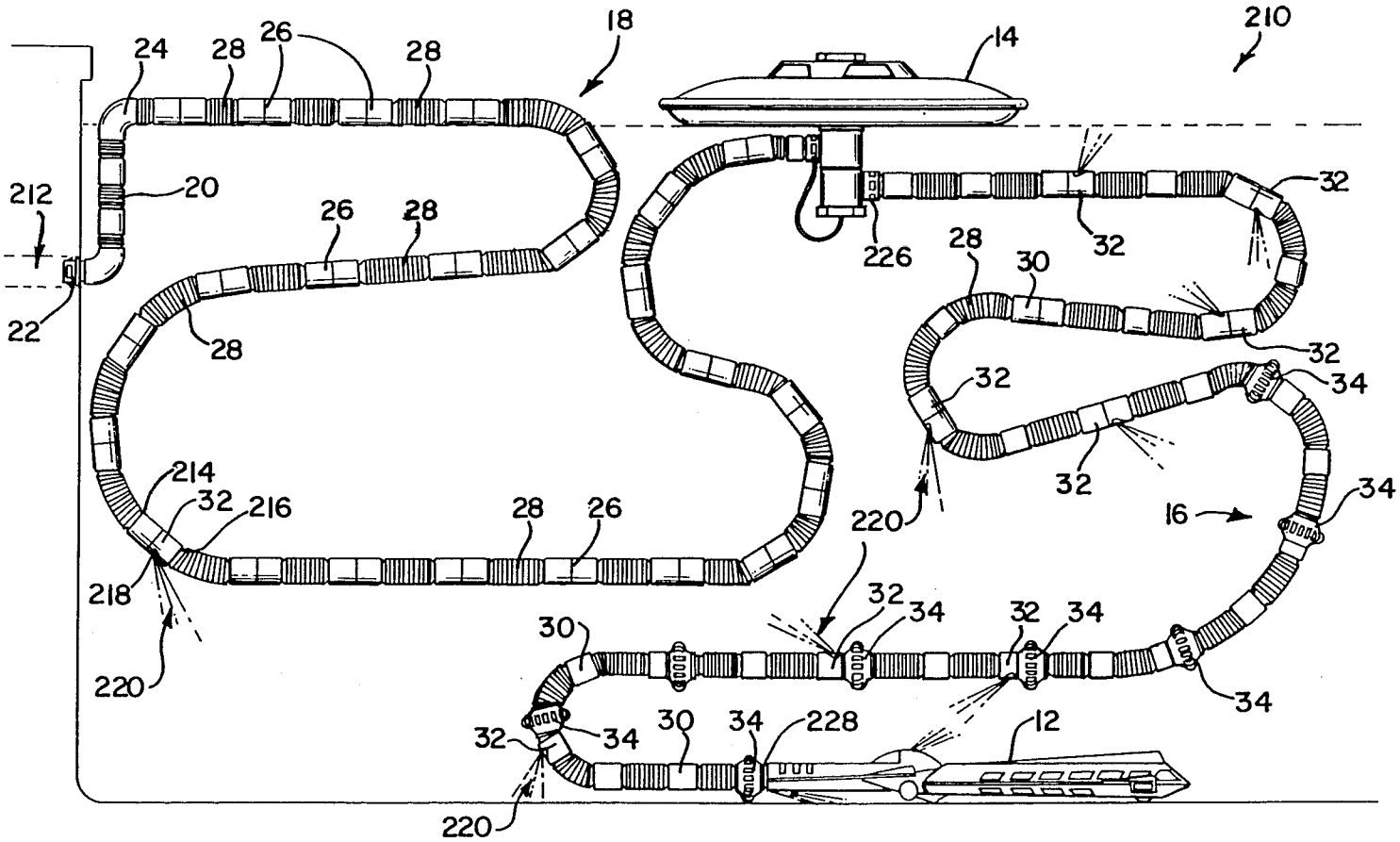
FIG. 11 shows a perspective view of a second embodiment of a swimming pool cleaning apparatus in accordance with the invention.
Figure 12:
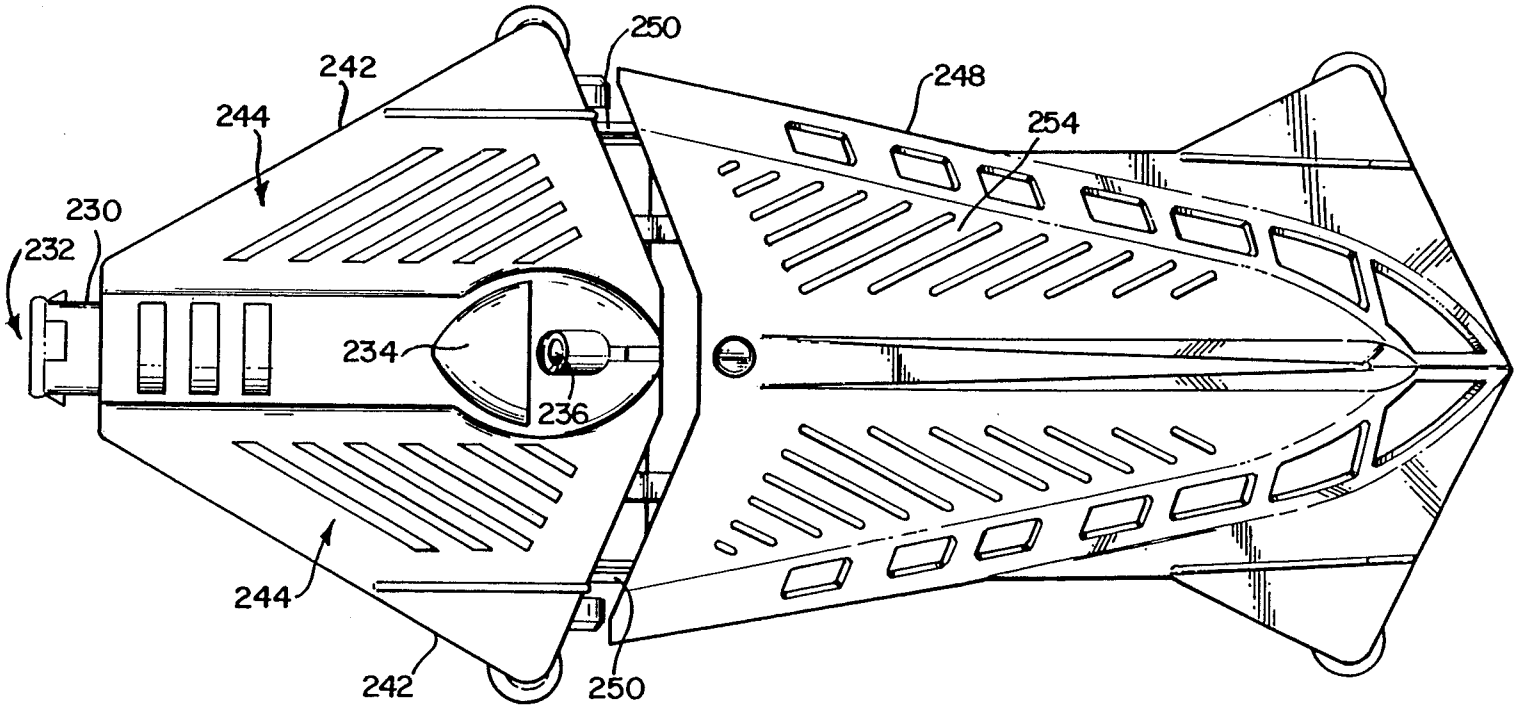
FIG. 12 shows a plan view of the cleaning head of the apparatus of FIG. 11.
Figure 13:
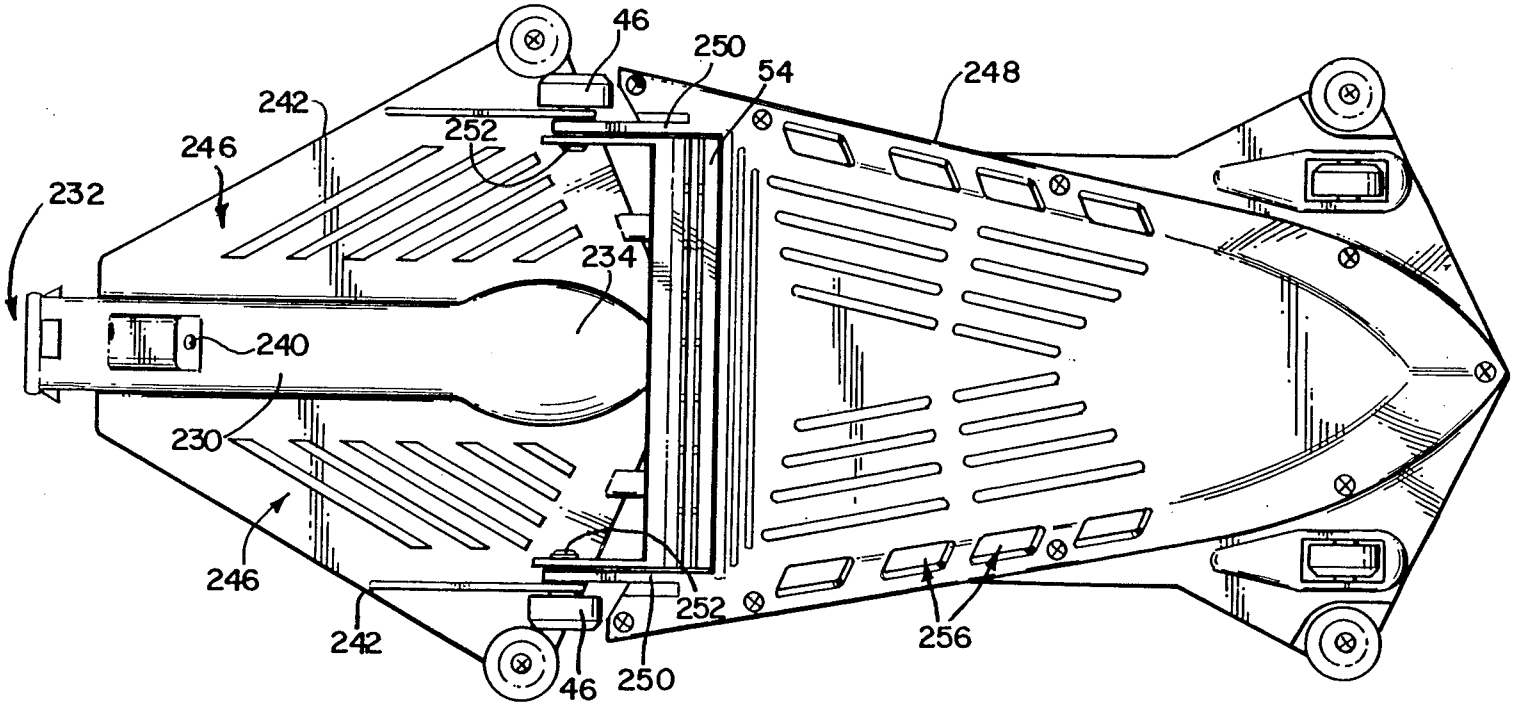
FIG. 13 shows an underneath plan view of the cleaning head.
Figure 14:
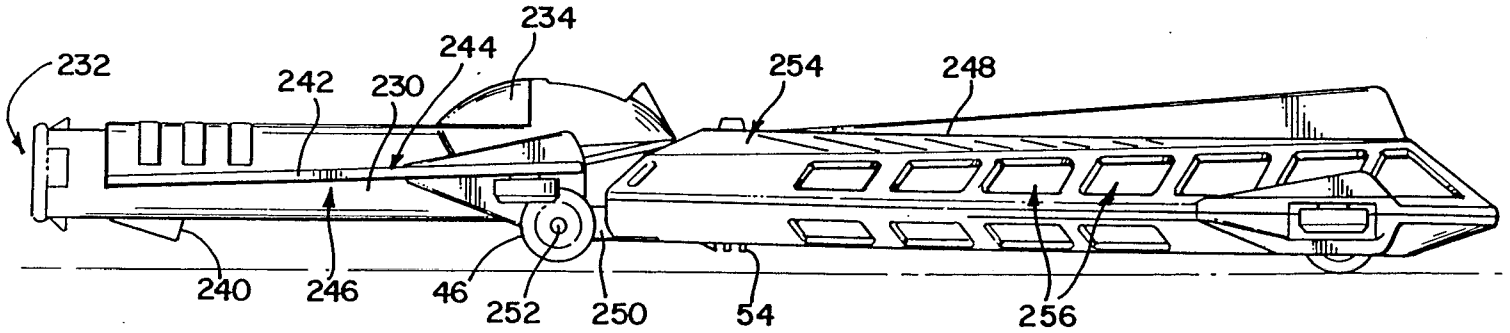
FIG. 14 shows a side view of the cleaning head.
Figure 15:
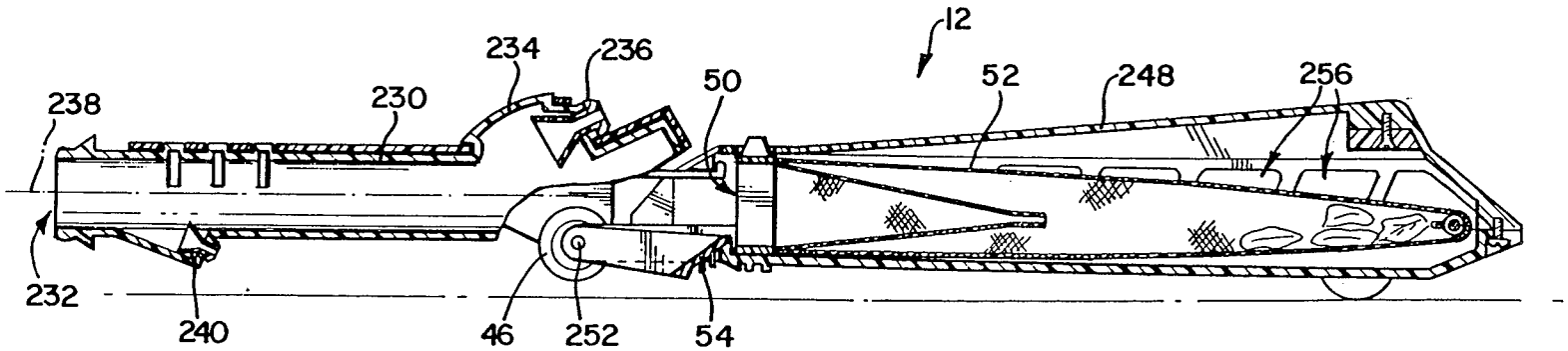
FIG. 15 shows a sectioned view of the cleaning head.

Referring now to FIG. 11, a second embodiment of an apparatus for cleaning a swimming pool is designated generally by reference numeral 210. The apparatus 210 is similar to the apparatus 10 of FIG. 1 and is similarly referenced. Thus the apparatus 210 has a cleaning head 12, a surface unit 14, an underwater hose 16 connecting the cleaning head 12 to the surface unit 14 and a surface hose 18 connecting the surface unit 14 to an inlet 212 through which filtered water is returned to the pool, under pressure, from a pump (not shown).

Figure 18:
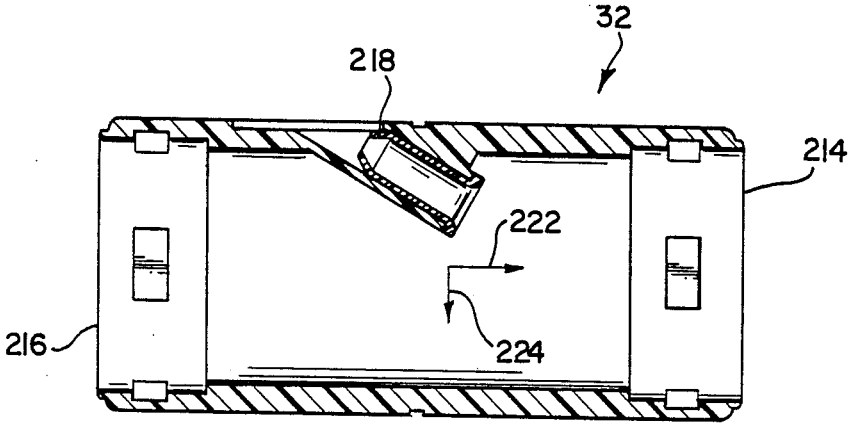
FIG. 18 shows a sectioned view of a jet connector.

The surface hose 18 of this apparatus 210 has only one jet connector 32 which is shown in more detail in FIG. 18. The connector 32 has an inlet end 214 and an outlet end 216. The connector 32 has a single jet 218 that is angled towards the outlet end 216 so that a jet of water is directed in a downstream direction as shown at 220 in FIG. 1. This jet of water 220 provides a thrust on the connector having a longitudinal component 222 directed in an upstream direction and a transverse component 224. The longitudinal thrust component 222 tends to move the connector 32, and the hose sections 28 connected thereto in an upstream direction and the transverse thrust component 224 tends to move the connector 32 sideways. Depending on the orientation of the portion of the surface hose 18 between the connector 32 and the surface unit 14, ie. if this portion is fairly straight, the surface hose 18 will exert a pulling force on the surface unit 14. If this portion is not straight, the thrust exerted on the connector 32 will tend to straighten this portion of the surface hose 18.

Similarly, the underwater hose 16 has jet connectors 32 that also all have only one jet 218, each jet 218 also being directed at an angle in the downstream direction. These jets 218 provide water jets 220 that each provide a thrust having a longitudinal component directed upstream so that the underwater hose 16 exerts a pushing force on the surface unit 14 and a pulling force on the cleaning head 12. The various jet connectors 32 of the underwater hose 16 also experience sideways forces that cause the various portions of the underwater hose 16 to move sideways. As there are the swivel connectors 30, the angular directions of the various transverse thrust components 224 of the jet connectors 32 about a longitudinal axis of each jet connector 32 varies resulting in extremely random movement of the hose sections 28, an inlet end 226 of the underwater hose 16 that is connected to the surface unit 14 and an outlet end 228 connected to the cleaning head 12.

Turning now to FIGS. 12 to 15 the cleaning head 12 has a hollow elongate body portion 230 having an inlet end 232 that is connected to the outlet end 228 of the underwater hose 16. At its other end, the body portion 230 has a bulbous region 234 in which is positioned a main jet 236 that is directed in a generally downstream direction, (ie. away from the inlet end 232) at an angle to a longitudinal axis 238 of the body portion 230. The body portion 230 also carries an auxiliary jet 240 intermediate its ends and on the other side of the body portion 230 to the main jet 236. The auxiliary jet 240 is also angled in a downstream direction so that water streams issuing from both the main jet 236 and the auxiliary jet 240 provide a thrust having a longitudinal component which moves the body portion 230 towards its inlet end 232, assisting the underwater hose 16 in moving the cleaning head through the water. The water streams exert transverse thrust components that exert a couple on the body portion 230 tending to rotate it against the drag of the underwater hose 16 so that the bulbous region 234 tends to be at an angle to the general direction of movement of the body portion 230.

Attached to the body portion 230 are two generally triangular and planar wings 242 which are substantially co-planar and define a median plane between the main jet 236 and the auxiliary jet 240. The wings 242 are nonetheless slightly angled, being closer to the main jet 236 at the bulbous region 234. The wings 242 extend almost from the inlet end 232 of the body portion 230 to the bulbous region 234 and widen out from the inlet end 232. The surfaces 244 of the wings 242 on the side of the main jet 236 constitute an upper side and the other surfaces 246, on the side of the auxiliary jet 240 constitute an underneath side of the cleaning head 12.

A flattened housing 248 extends back from the wings 242 and is pivotally attached thereto at the ends of arms 250 by pivot pins 252. The pins 252 also support wheels 46. In a normal position the upper side 254 of the housing 248 is substantially in line with the upper surfaces 244 of the wings 242. Further, at its front end adjacent the body portion 230, the housing 248 defines the mouth 50. The bag 52 is located within the housing 248 with its open end in the mouth 50. The housing 248 has openings 256 through which water that has passed into the mouth 50 and through the bag 52, may flow. It will be appreciated that the auxiliary jet 240 directs water flow generally in the direction of the mouth 50 and that if the underneath side of the cleaning head 12 is close to or against a floor or wall 258 of the pool, then water from the auxiliary jet 240 will dislodge dirt and will be deflected into the mouth 50. Further, the action of the main jet 236 and the angled wings 242 will tend to keep the cleaning head against the floor or wall 258.

Figure 16:
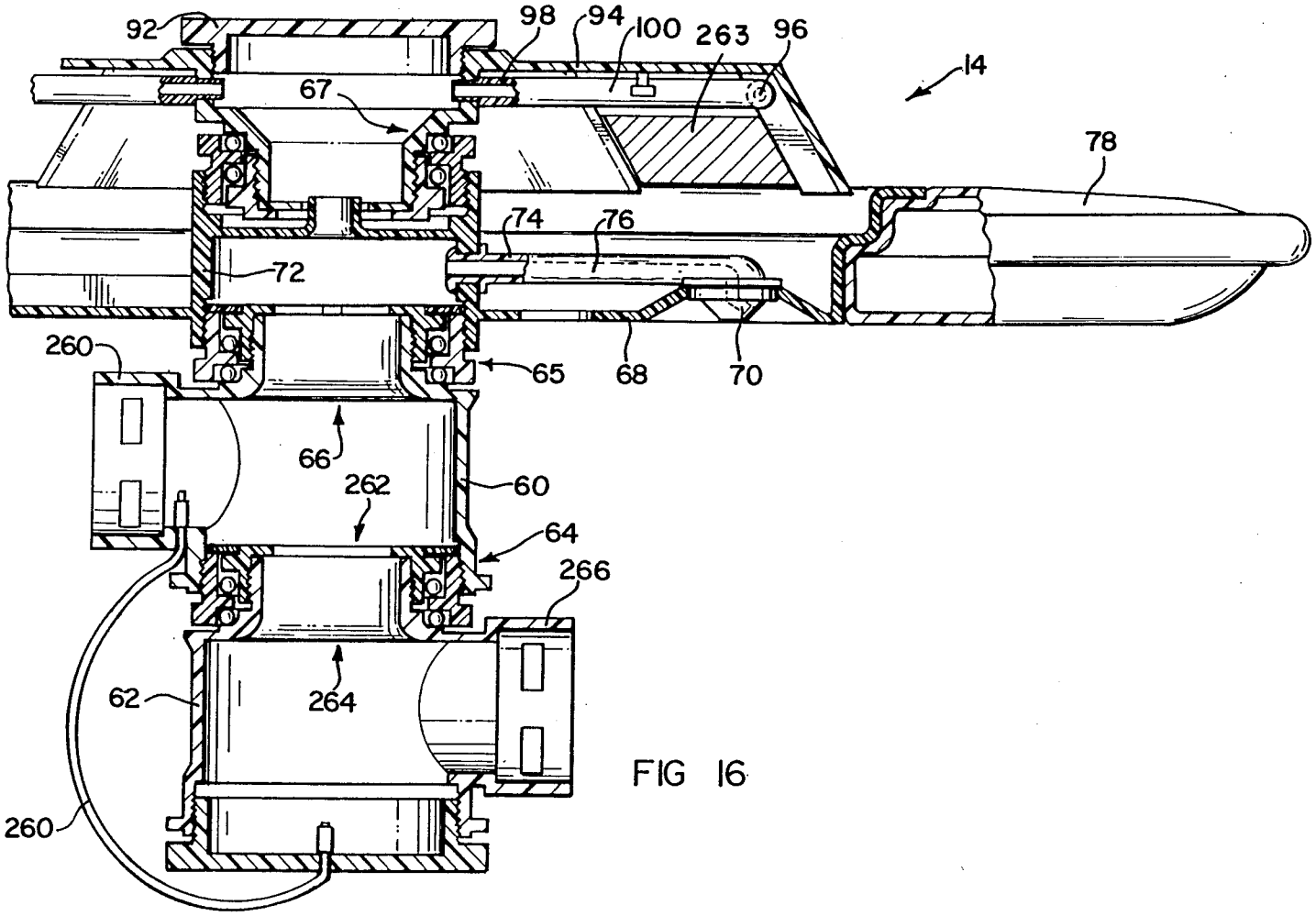
FIG. 16 shows a sectioned view of part of a surface unit of the apparatus of FIG. 11.
Figure 17:
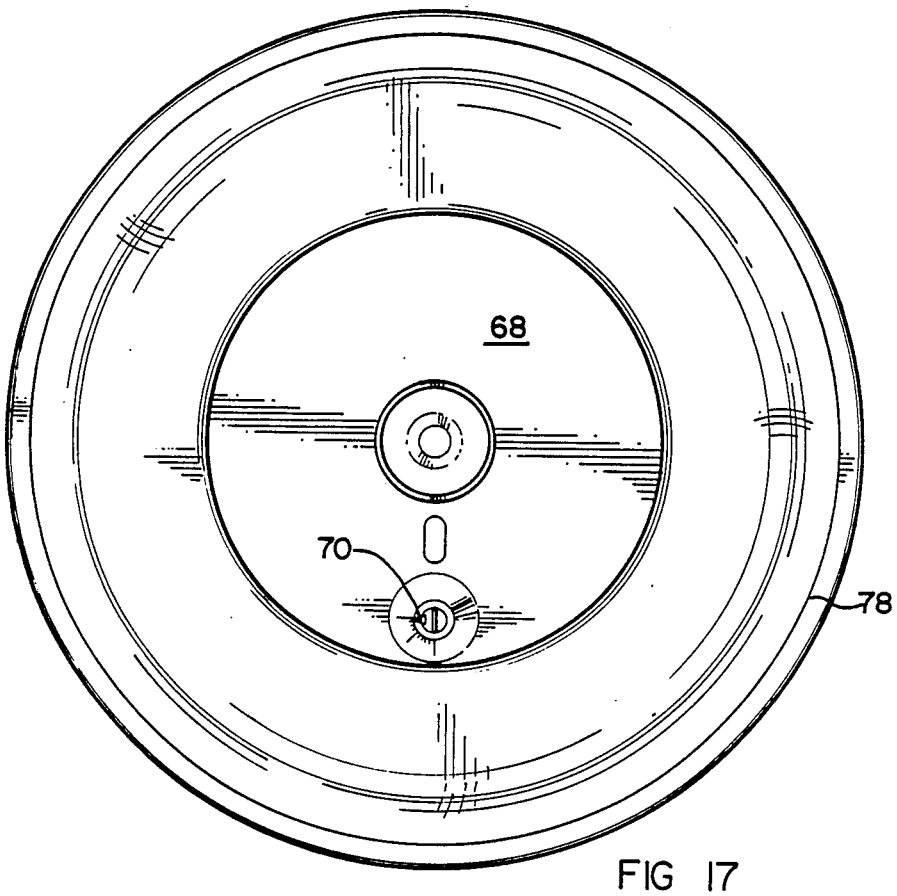
FIG. 17 shows an underneath plan view of the surface unit without its connecting elements.

With reference to FIGS. 16 and 17, it will be seen that the surface unit 14 of the apparatus 210 is substantially similar to the surface unit 14 of the apparatus 10, except for minor constructional detail and that this surface unit only has one displacing jet 70 which can be rotated through 90° to be directed tangentially to the vertical rotational axis or radially outwardly thereto or at any angle in between, and that there is a leash or strap 260 between the inlet member 60 and the outlet member 62 which limits relative rotation to about 630°. It will be noted further that there is an unbalancing mass 263 on the spinner 94 which causes it to wobble as it spins. In use the spinner 94 is above the surface of the water and water exiting from the jets 96 sprays onto the surface. It will be noted further that the members 60 and 62 are below the tray 68 and the member 60 has a transversely directed inlet 260 to which the outlet end of the surface hose 18 is connected and an axial outlet 262 that communicates with a complementary axial inlet 264 of the member 62. The member 62, in turn, has a transversely directed outlet 266 to which the inlet end 226 of the underwater hose 16 is connected. As the surface and underwater hoses 18 and 16 extend substantially horizontally adjacent the surface unit 14, the forces that the hoses 16 and 18 exert on the surface unit 14 tend to move the surface unit about on the surface. The speed and direction in which the surface unit 14 moves will depend on the relative orientation of the members 60 and 62 and the jet 70. Further, if the hoses 16 and 18 are being displaced such that the members 60 and 62 are relatively rotated too much in one direction they will reach the limit imposed by the leash 260 and further relative rotation in that direction will be halted. Due to the configuration of the underwater hose 16, and the fact that the jet connectors 32 will constantly change their relative orientations, the underwater hose 16 will, sooner or later, be displaced in such a way as to cause relative rotation of the members 60 and 62 in the opposite direction. As a result, the surface unit 14 will then move away from an obstruction. It will also be appreciated that as the surface unit 14 is linearly displaced by three forces that are randomly changing direction relative to one another, and because the periphery of the surface unit 14 is rotating, it is very unlikely that the surface unit will get stuck and its movement about the pool's surface is extremely random. As the surface unit 14 wobbles on the surface it creates large ripples that give a particularly pleasing and welcome appearance to the swimming pool. The water that is sprayed onto the surface is also pleasant and has the functional advantage of wetting items floating on the surface, thereby causing them to sink more quickly to be collected by the cleaning head 12.

The cleaning head 12 is non-buoyant in the water and has a specific gravity slightly greater than unity so that it sinks slowly in water and, in rest it lies on the floor of the pool. However, in use, due to the hydrodynamic forces exerted on it as it moves through the water it does not remain on the floor and moves through the body of water, at times moving against the floor and side walls.

I claim:

1. An apparatus for cleaning a body of liquid in a pool having walls and a bottom, comprising an elongated drive hose having an inlet end for receiving liquid under pressure and an opposite outlet end;

a buoyant and movable surface unit for supporting the inlet end of the drive hose above the bottom of the pool;

a plurality of drive jets spaced apart along the drive hose and communicating with the interior thereof to receive liquid under pressure and discharge the liquid into the body of liquid, the jets being positioned to discharge the liquid generally longitudinally of the drive hose in the direction of the outlet end to produce thrust for driving the drive hose longitudinally in the direction of its inlet end with at least some of the drive jets being angled to develop thrust having a component at a right angle to the drive hose;

a non-buoyant cleaning unit attached to the outlet end of the drive hose to trail behind the drive hose as it is driven through the water, the cleaning unit having a body portion having an open mouth facing toward the drive hose to receive debris from the body of liquid as the unit moves through the liquid, a support member defining the mouth, a woven bag carried in the unit by the support member for collecting debris, a hollow portion connecting the body portion to the outlet end for receiving liquid under pressure from the drive hose, a main jet receiving liquid under pressure from the hollow portion and positioned on the unit to discharge the liquid in a direction to develop thrust both longitudinally of the drive hose to assist the drive jets in driving the drive hose and the cleaning unit and transversely to displace the cleaning unit to one side, and an auxiliary jet also receiving liquid under pressure from the hollow portion and positioned on the unit to discharge liquid towards the mouth to assist in the passage of debris into the mouth.

2. An apparatus for cleaning a body of liquid in a pool having walls and a bottom, comprising an elongated drive hose having an inlet end for receiving liquid under pressure and an opposite outlet end;

a plurality of drive jets spaced apart along the drive hose and communicating with the interior thereof to receive liquid under pressure from the drive hose and discharge the liquid into the body of liquid, the jets being positioned to discharge the liquid generally longitudinally of the drive hose in the direction of the outlet end to produce thrust for driving the drive hose longitudinally in the direction of the inlet end;

a means for supporting the inlet end movably in the body of liquid;

a non-buoyant cleaning unit carried by the drive hose adjacent its outlet end to be pulled by the drive hose through the body of liquid and having an open side, means attaching the cleaning unit to the drive hose with the open side facing longitudinally of the drive hose in an upstream direction and positioned to move through the body of liquid and along the bottom and walls of the pool;

and a main jet on the cleaning unit for receiving liquid under pressure from the drive hose and for discharging the liquid into the body of liquid, the main jet being positioned on the cleaning unit to produce thrust both longitudinally of the drive hose, to assist the drive jets in propelling the drive hose and cleaning unit and transversely to displace the cleaning unit toward one side as it moves through the body of liquid.

3. An apparatus for cleaning a body of liquid as defined in claim 2 wherein at least some of the drive jets are positioned on the drive hose to produce thrust having a transverse component to displace the drive hose in a transverse direction.

4. An apparatus for cleaning a body of liquid as defined in claim 2 wherein the cleaning unit has a body portion that extends in a direction longitudinally of the drive hose away from the outlet end, a support spaced from the body portion adjacent the outlet end to define the mouth, and a bag lying along the body portion and having an open end connected to the support and to the body portion to collect debris.

5. An apparatus for cleaning a body of liquid as defined in claim 4 wherein the main jet is on the side of the body portion opposite the support and is located to urge the body portion in the direction of the support.

6. An apparatus for cleaning a body of liquid as defined in claim 2 wherein the means for supporting the inlet end comprises a buoyant surface unit, and further including a supply hose for delivering liquid under pressure to the inlet end at the surface unit.

7. An apparatus for cleaning a body of liquid as defined in claim 6 wherein the surface unit has means thereon for displacing itself through the liquid and thereby cooperating with the drive jets and the main jet in moving itself and the drive hose through the body of liquid.

8. An apparatus for cleaning a body of liquid as defined in claim 7 wherein the surface unit has a means for displacing the surface unit through the liquid in a changing direction to produce a random course through the liquid.

9. An apparatus for cleaning a body of liquid as defined in claim 3, in which at least one pair of drive jets are carried by hose portions that are swivelably attached to one another, to be relatively rotatable about a longitudinal axis.

10. An apparatus for cleaning a body of liquid, comprising an elongated drive hose having an inlet end for receiving liquid under pressure and an opposite outlet end;

a jet means on the drive hose spaced from the outlet end and communicating with the interior of the drive hose to receive liquid under pressure and discharge the liquid into the body of liquid, the jet means being located and directed to produce thrust for driving the drive hose longitudinally in an upstream direction, wherein the jet means comprises a plurality of jets spaced apart along the drive hose and postioned to produce both longitudinal thrust and lateral thrust for displacing the drive hose;

a non-buoyant cleaning unit carried by the drive hose adjacent its outlet end to be pulled by the drive hose through the body of liquid, and having an open side forming a mouth facing along the drive hose in the general direction of the inlet end for receiving debris as the cleaning unit is pulled through the liquid, the unit carrying a means for collecting and holding the debris; and additional jet means located on the cleaning unit for receiving liquid under pressure from the drive hose and directed to produce additional thrust for driving the drive hose and the cleaning unit.

11. An apparatus for cleaning a body of liquid as defined in claim 10 wherein the additional jet means is directed to produce both lateral and longitudinal thrust.

12. An apparatus for cleaning a body of liquid as defined in claim 10 further including an auxiliary jet on the cleaning unit in advance of the mouth and located to direct a flow of liquid toward the mouth to assist in collecting debris in the cleaning unit.

13. An apparatus for cleaning a body of liquid as defined in claim 10 further including a buoyant surface unit connected to the drive hose at the inlet end for supporting the inlet end for movement around the body of liquid.

14. An apparatus for cleaning a body of liquid as defined in claim 13 further including a means on the surface unit for cooperating with the jet means in displacing the surface unit randomly around the body of liquid.

15. An apparatus for cleaning a body of liquid as defined in claim 10, which includes a swivel coupling to which adjacent hose portions are attached, these hose portions each carrying a jet.

16. A method of cleaning a body of liquid having a surface which includes supporting an inlet end of a length of drive hose at the surface of the body of liquid by means of a buoyant support unit;

charging pressurized liquid into the inlet end of the drive hose;

releasing liquid from the drive hose at a plurality of positions along its length so that at each position a thrust is exerted on the hose which has a transverse component and a longitudinal component which is directed in an upstream direction, and at an outlet end of the drive hose which is remote from the inlet end in a generally downstream direction to displace the drive hose through the body of liquid in a generally upstream direction and to push the support unit across the surface; and pulling a non-buoyant bag-like cleaning member attached to the drive hose, by means of the drive hose, to collect debris in the body of liquid.

17. The method claimed in claim 16, in which the bag-like cleaning member is carried by a rigid hollow element that is connected to the outlet end of the drive hose in fluid communication therewith and liquid is released from the hollow element to displace this element towards the outlet end of the drive hose.

18. A method of cleaning a body of liquid having a surface which includes supporting an inlet end of a length of drive hose at the surface of the body of liquid by means of a buoyant support unit;

charging pressurized liquid into the inlet end of the drive hose by charging liquid into an inlet end of a further supply hose that has a remote outlet end also carried by the support unit in fluid communication with the inlet end of the drive hose;

releasing liquid from the drive hose at a plurality of positions along its length and at an outlet end of the drive hose which is remote from the inlet end in a generally downstream direction to displace the drive hose through the body of liquid in a generally upstream direction and to push the support unit across the surface; and pulling a non-buoyant bag-like cleaning member attached to the drive hose, by means of the drive hose, to collect debris in the body of liquid.

19. The method claimed in claim 18, in which the bag-like cleaning member is carried by a rigid hollow element that is connected to the outlet end of the drive hose in fluid communication therewith and liquid is released from the hollow element to displace this element towards the outlet end of the drive hose.

20. The method claimed in claim 18, which includes releasing liquid from the supply hose at various positions along its length to displace its outlet end towards its inlet end and to pull the support unit across the surface.

21. The method claimed in claim 20, which includes releasing liquid at an angle to the hose at the various positions so that at each position a thrust is exerted on the supply hose which has a transverse component and a longitudinal component which is directed in an upstream direction.

22. A method of cleaning a body of liquid comprising the steps of providing an elongated hose having an inlet end;

movably supporting the inlet end of the hose adjacent the surface of the liquid;

supporting an open-ended non-buoyant debris collecting member on the hose adjacent the outlet end with the open end facing towards the hose;

supplying fluid under pressure to the inlet end to flow through the hose;

releasing fluid from the hose in a plurality of jets spaced along the length of the hose to propel the hose through the body of liquid;

releasing fluid from the hose adjacent the collecting member in a direction to displace the member laterally; and releasing fluid from the hose in advance of the open end of the member in a direction to create a flow into the member.

* * * * *